US008977165B2

(12) United States Patent
Jung et al.

(10) Patent No.: US 8,977,165 B2
(45) Date of Patent: Mar. 10, 2015

(54) MULTI-PASS TYPE IMAGE FORMING APPARATUS

(71) Applicant: Samsung Electronics Co., Ltd., Suwon-si, Gyeonggi-do (KR)

(72) Inventors: Tae Il Jung, Suwon-si (KR); Yong Geol Chung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/680,398

(22) Filed: Nov. 19, 2012

(65) Prior Publication Data

US 2013/0136500 A1 May 30, 2013

(30) Foreign Application Priority Data

Nov. 21, 2011 (KR) ..... 10-2011-0121792

(51) Int. Cl.

| | |
|---|---|
| ***G03G 15/00*** | (2006.01) |
| ***G03G 15/01*** | (2006.01) |
| ***G03G 21/16*** | (2006.01) |
| ***G03G 21/18*** | (2006.01) |

(52) U.S. Cl.

CPC ..... *G03G 15/80* (2013.01); *G03G 15/0147* (2013.01); *G03G 21/1647* (2013.01); *G03G 21/1676* (2013.01); *G03G 21/186* (2013.01)

USPC ..... 399/167

(58) Field of Classification Search

CPC ..... G03G 15/80; G03G 15/0147

See application file for complete search history.

(56) References Cited

U.S. PATENT DOCUMENTS

| | | | | |
|---|---|---|---|---|
| 2008/0124129 | A1* | 5/2008 | Lee | 399/167 |
| 2008/0261768 | A1* | 10/2008 | Miyawaki et al. | 475/284 |
| 2009/0123181 | A1* | 5/2009 | Ito et al. | 399/167 |
| 2010/0303503 | A1* | 12/2010 | Woo | 399/167 |
| 2012/0148302 | A1* | 6/2012 | Lee et al. | 399/121 |

* cited by examiner

*Primary Examiner* — Clayton E Laballe
*Assistant Examiner* — Arlene Heredia Ocasio
(74) *Attorney, Agent, or Firm* — Staas & Halsey LLP

(57) ABSTRACT

A multi-pass type image forming apparatus allows driving-couplings to couple with and separate from an image-carrier and developing units simultaneously. The apparatus includes a main body, a cover to open or close the main body, an image-carrier unit including an image-carrier and first driven-coupling connected to the image-carrier, developing units including a developing roller and a second driven-coupling connected to the developing roller, first and second driving-couplings to transmit drive power to the first and second driven-couplings, a link unit to move in a first direction in linkage with opening/closing operations of the cover, and a guide unit to be rotatable about the first driving-coupling in linkage with the link unit, the guide unit being moved when rotated about the first driving-coupling so as to couple or separate the first and second driving-couplings to or from the first and second driven-couplings.

36 Claims, 12 Drawing Sheets

MULTI-PASS TYPE IMAGE FORMING APPARATUS

CROSS-REFERENCE TO RELATED APPLICATIONS

This application claims the benefit of Korean Patent Application No. 2011-0121792, filed on Nov. 21, 2011 in the Korean Intellectual Property Office, the disclosure of which is incorporated herein by reference in its entirety.

BACKGROUND OF THE INVENTION

1. Field of the Invention

Embodiments of the present inventive concept relate to a multi-pass type image forming apparatus having an assembly to transmit power to an image-carrier and a developing unit through a coupling.

2. Description of the Related Art

Generally, image forming apparatuses are devised to form an image on a printing medium according to input signals. Examples of image forming apparatuses include printers, copiers, fax machines, and devices combining functions thereof.

One type of image forming apparatus is an electro-photographic image forming apparatus that includes an image-carrier, a light scanning unit, and a developing unit. The light scanning unit forms an electrostatic latent image on a surface of the image-carrier by irradiating light to the image-carrier that has been charged with a predetermined electric potential. The developing unit forms a visible image by supplying developer to the image-carrier on which the electrostatic latent image has been formed.

Commonly, yellow, magenta, cyan and black toners are used in the image forming apparatus, and thus four developing units may be necessary to attach the four colors of toners to the electrostatic latent image.

Image forming methods include a single-pass method in which each of four developing units includes an image-carrier, and a multi-pass method in which four developing units share a single image-carrier.

In the case of the multi-pass method, the four developing units are concentrically arranged about the image-carrier to share a single image-carrier.

A conventional multi-pass type image forming apparatus includes driving couplers to drive an image-carrier and four developing units, which are movable independently of one another and are adapted to be coupled to or separated from the image-carrier and the developing units.

The above-described configuration, however, may require devices to couple or separate the driving couplers to or from the image-carrier and developing units equal in number to the number of driving couplers. Therefore, the number of constituent elements is increased, causing higher manufacturing costs. Moreover, an expanded installation space may prevent reduction in the size of the image forming apparatus.

SUMMARY OF THE INVENTION

Therefore, the present inventive concept provides a multi-pass type image forming apparatus having an improved assembly to allow driving-couplings to be coupled to and separated from an image-carrier and developing units simultaneously.

The present inventive concept also provides a multi-pass type image forming apparatus having an improved configuration to reduce the size of the image forming apparatus.

Additional features and utilities of the present inventive concept will be set forth in part in the description which follows and, in part, will be obvious from the description, or may be learned by practice of the inventive concept.

Exemplary embodiments of the present inventive concept provide an image forming apparatus including a main body, a cover to open or close one side of the main body, an image-carrier unit placed in the main body and including an image-carrier on which an image is formed and a first driven-coupling connected to a rotating shaft of the image-carrier, a plurality of developing units mounted in the main body to slidably move through one side of the main body opened by the cover, each of which includes a developing roller to feed developer to the image-carrier and a second driven-coupling connected to a rotating shaft of the developing roller, a first driving-coupling and a second driving-coupling located in a side region of the main body to transmit drive power generated from a drive source to the first driven-coupling and the second driven-coupling, a link unit to move in a first direction in linkage with opening/closing operations of the cover, and a guide unit to be rotatable about a rotating shaft of the first driving-coupling in linkage with the link unit, the guide unit being adapted to move in a second direction perpendicular to the first direction when rotated about the rotating shaft of the first driving-coupling so as to couple or separate the first driving-coupling and the second driving-coupling to or from the first driven-coupling and the second driven-coupling.

The second driven-coupling may be concentrically arranged about the first driven-coupling in a state in which the plurality of developing units is mounted in the main body.

The second driving-coupling may be concentrically arranged about the first driving-coupling.

The first driving-coupling and the second driving-coupling may be pressed by the guide unit and connected respectively to the first driven-coupling and the second driven-coupling as the cover closes one side of the main body, and may be no longer pressed by the guide unit and separated from the first driven-coupling and the second driven-coupling as the cover opens one side of the main body.

The guide unit may include a first through-hole formed in a rotation center thereof, and a second through-hole formed in a circumferential direction of a concentric circle defined by the second driving-coupling.

The first driving-coupling may be connected to the first driven-coupling via the first through-hole, and the second driving-coupling may be connected to the second driven-coupling via the second through-hole.

The guide unit may include a first support portion and a second support portion formed at one surface thereof, the first support portion being formed along the first through-hole to support the first driving-coupling, and the second support portion being formed along the second through-hole to support the second driving-coupling.

The first driving-coupling may include a first flange having a greater diameter than a diameter of the first through-hole so as to be supported by the first support portion.

The second driving-coupling may include a second flange having a greater diameter than a radial width of the second through-hole so as to be supported by the second support portion.

The image forming apparatus may further include a plurality of elastic members to press the first driving-coupling and the second driving-coupling toward the first driven-coupling and the second driven-coupling, so as to maintain contact between the first and second flanges and the first and second support portions.

The second direction may be an axial direction of the rotating shaft of the first driving-coupling.

The image forming apparatus may further include a guide cover provided at one side of the main body to receive the guide unit, and the guide cover may include at least one first guide protrusion to come into contact with one surface of the guide unit so as to guide movement of the guide unit in the second direction as the guide unit rotates about the rotating shaft of the first driving-coupling.

The guide unit may include at least one second protrusion to come into contact with the first guide protrusion so as to guide movement of the guide unit in the second direction.

The first guide protrusion may include a slope to guide movement of the second guide protrusion as the guide unit rotates about the rotating shaft of the first driving-coupling.

The slope may be inclined in a rotating direction of the guide unit.

The at least one first guide protrusion and the at least one second guide protrusion may be arranged in the rotating direction of the guide unit.

Exemplary embodiments of the present general inventive concept also provide an image forming apparatus including a main body, a cover to open or close one side of the main body, a plurality of rotators placed in the main body, a plurality of driven-couplings connected to rotating shafts of the rotators, a plurality of driving-couplings placed in a side region of the main body to transmit drive power generated from a drive source to the driven-couplings, a link unit to move in linkage with opening/closing operations of the cover, and a guide unit to be rotatable about one rotating shaft of the plurality of driving-couplings in linkage with the link unit, the guide unit being adapted to move toward the driven-couplings when rotated so as to cause the driving-couplings to be engaged with the driven-couplings, and to move away from the driven-couplings when rotated so as to cause the driving-couplings to be separated from the driven-couplings.

The guide unit may include a plurality of through-holes perforated therein to enable connection between the plurality of driving-couplings and the plurality of driven-couplings, and a plurality of support portions formed on peripheries of the through-holes to support the plurality of driving-couplings.

The image forming apparatus may further include a plurality of elastic members to press the driving-couplings toward the driven-couplings, so as to allow the driving-couplings to be supported by the support portions and be moved in a rotating shaft direction of the driving-couplings along with the guide unit.

The plurality of driven-couplings may include a first driven-coupling connected to a rotating shaft of an image-carrier on which an image is formed, and a plurality of second driven-couplings connected to a rotating shaft of a developing roller that feeds developer to the image-carrier, and the plurality of second driven-couplings may be concentrically arranged about the first driven-coupling.

The plurality of driving-couplings may include a first driving-coupling positioned to correspond to the first driven-coupling so as to be engaged with the first driven-coupling, and a plurality of second driving-couplings positioned to correspond to the second driven-couplings so as to be engaged with the second driven-couplings.

The guide unit may be movable in the rotating shaft direction of the first driving-coupling when rotated about the rotating shaft of the first driving-coupling.

The image forming apparatus may further include a guide cover provided at one side of the main body to receive the guide unit.

The guide cover may include a first guide portion formed at an inner surface thereof facing one surface of the guide unit, and the first guide portion may include a first guide protrusion having a first slope that is inclined in a rotating direction of the guide unit.

At least one second guide portion may be placed at one surface of the guide unit in the rotating direction of the guide unit to guide movement of the guide unit along with the first guide portion, and the second guide portion may include a second guide protrusion having a second slope that moves relative to the first slope in contact with the first slope as the guide unit is rotated.

The first guide portion may include a first receiving recess in which the second guide protrusion is received in a state in which the cover closes the main body, and the second guide portion may include a second receiving recess in which the first guide protrusion is received in a state in which the cover closes the main body.

One end of the first guide protrusion and one end of the second guide protrusion may come into contact with each other in a state in which the cover opens the main body.

The guide unit may move toward the driven-couplings as the cover closes the main body, so as to allow the driving-couplings to be engaged with the driven-couplings, and may move away from the driven-couplings as the cover opens the main body, so as to allow the driving-couplings to be separated from the driven-couplings.

Exemplary embodiments of the present general inventive concept also provide an image forming apparatus comprising: a main body; a cover to open and close one side of the main body; a first driven-coupling and second driven-couplings to drive an image carrier and developing rollers, respectively; a first driving-coupling and second driving-couplings to transmit a drive power generated from a drive source to the first driven-coupling and second driven-couplings, respectively; and a guide unit to be rotatable about a rotating shaft of the first driving-coupling and configured to move toward the driven-couplings when rotated in a first direction so as to cause the driving-couplings to be engaged with the driven-couplings, and to move away from the driven-couplings when rotated in a second direction so as to cause the driving-couplings to be separated from the driven-couplings.

In an exemplary embodiment, the image forming apparatus also includes a link unit to move in linkage with opening/closing operations of an access cover of the main body such that the guide unit rotates with the movement of the link unit.

In an exemplary embodiment, the guide unit moves about the rotating shaft of the first driving-coupling and in a direction perpendicular to the movement of the link unit to perform the coupling and decoupling of the driving-couplings and driven-couplings.

In another exemplary embodiment, the second driven-couplings are disposed concentric with respect to the first driven-coupling and the second driving-couplings are disposed concentric with respect to the second driven-couplings.

In another exemplary embodiment, the first driving-coupling and second driving-couplings simultaneously move toward the first driven-coupling and second driven-couplings when the access cover is being closed, and move away from the first driven-coupling and second driven-couplings when the access cover is being opened.

In another exemplary embodiment, the first driving-coupling and second driving-couplings simultaneously move toward the first driven-coupling and second driven-couplings when the access cover is being closed, and move away from the first driven-coupling and second driven-couplings when the access cover is being opened.

In yet another exemplary embodiment, the guide unit includes a first through-hole formed in the rotation center thereof, a second through-hole formed in a circumferential direction of a concentric circle defined by the second driving-couplings, a first support portion to support the first driving-coupling, a second support portion to support the second driving-couplings, and a guide portion to guide axial movement of the guide unit during rotation of the guide unit.

BRIEF DESCRIPTION OF THE DRAWINGS

These and/or other features and utilities of the present inventive concept will become apparent and more readily appreciated from the following description of the embodiments, taken in conjunction with the accompanying drawings of which.

DETAILED DESCRIPTION OF THE PREFERRED EMBODIMENTS

Figure 1:
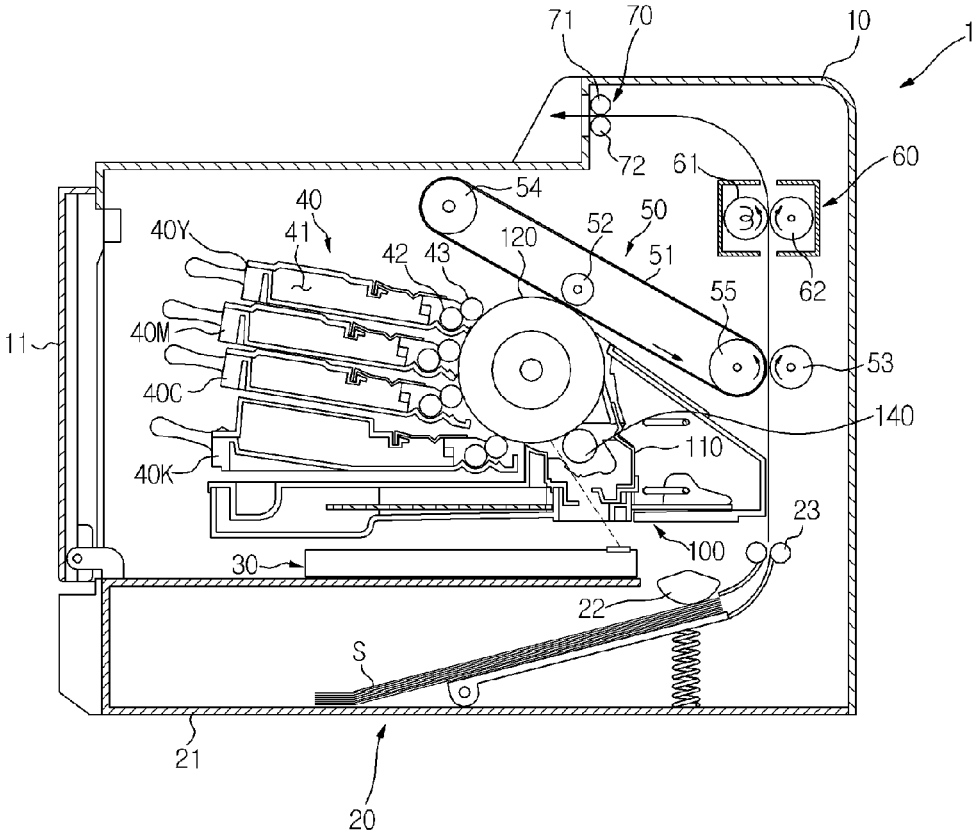
FIG. 1 is a view schematically illustrating a configuration of an image forming apparatus according to an embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
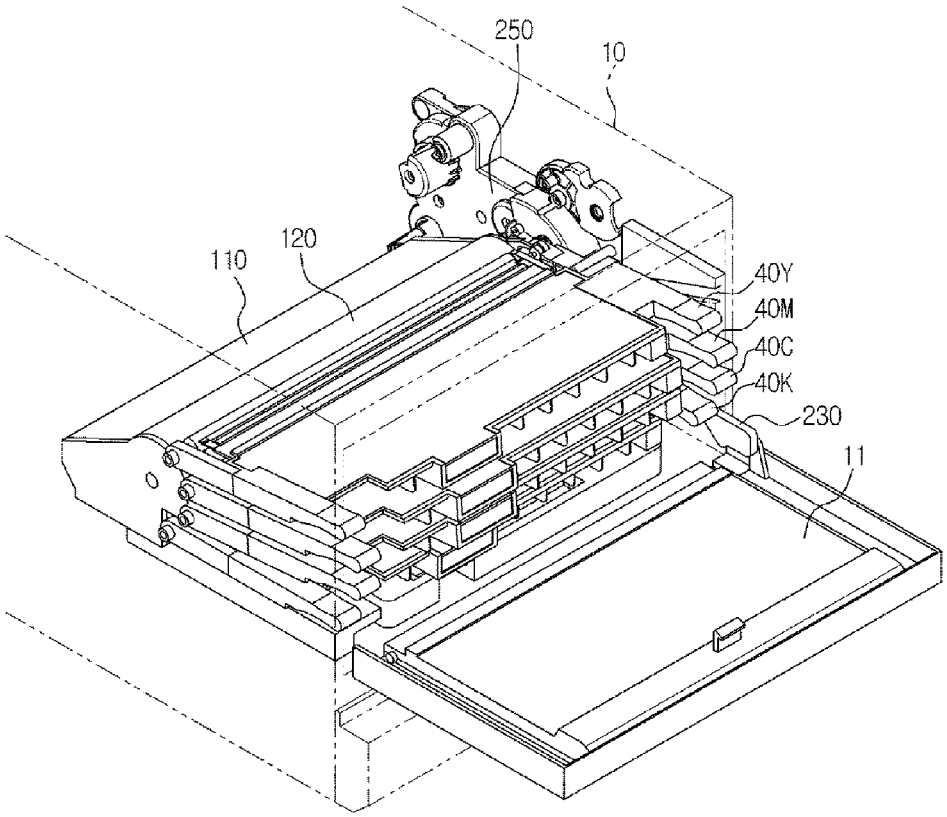
FIG. 2 is a perspective view illustrating a state in which developing units are mounted in a main body of the image forming apparatus.
Figure 3:
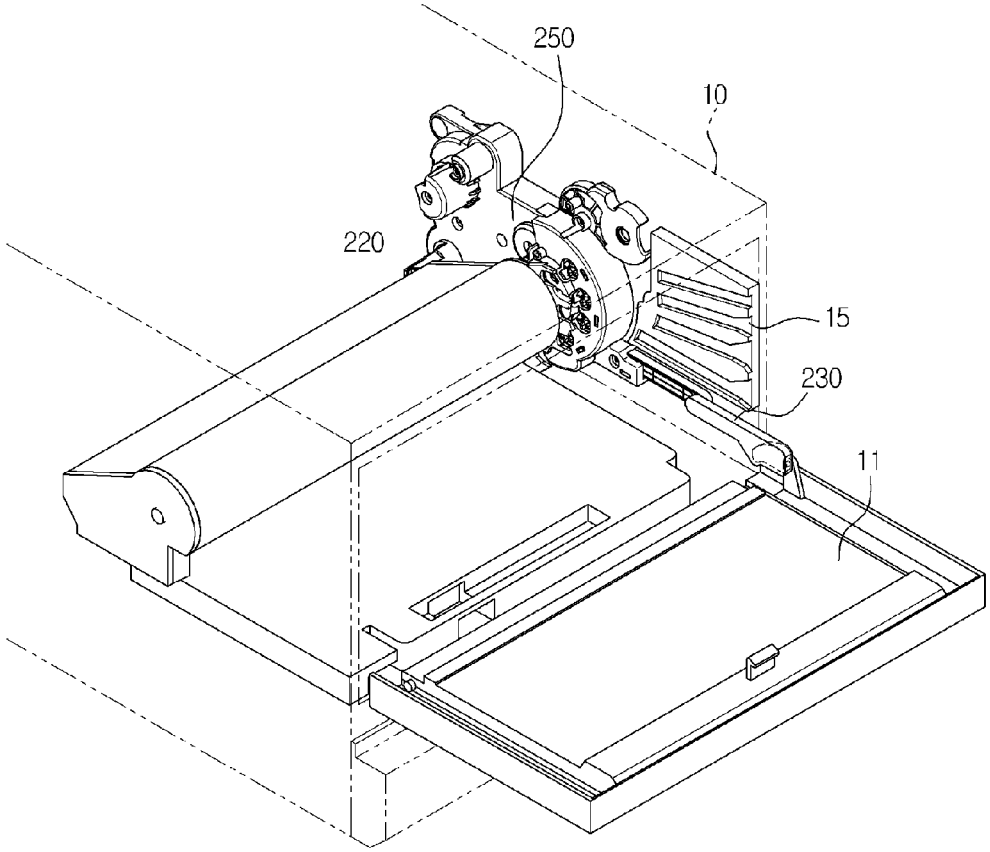
FIG. 3 is a perspective view illustrating a state in which the developing units are separated from the main body of the image forming apparatus.
Figure 4:
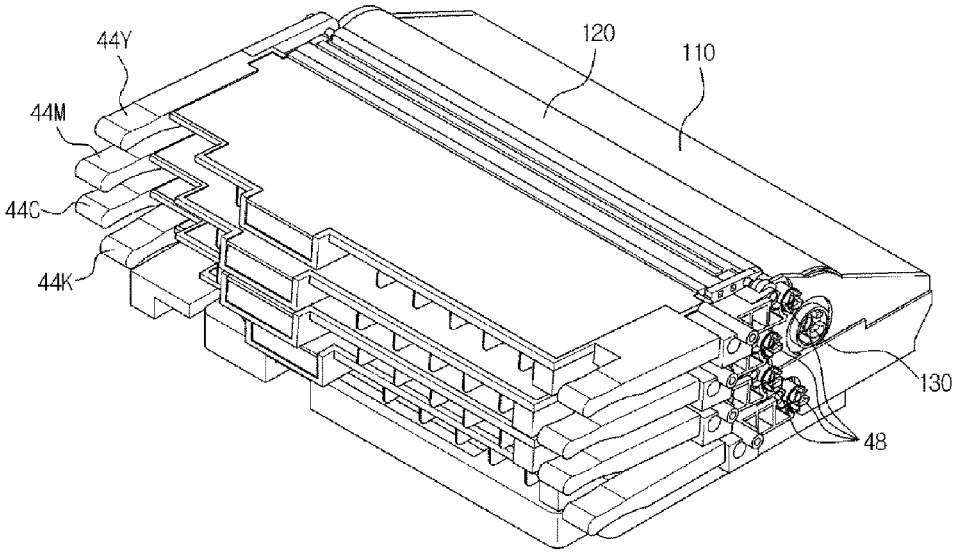
FIG. 4 is a perspective view illustrating a positional relationship between an image-carrier and the developing units.

FIG. 1 is a view schematically illustrating a configuration of an image forming apparatus according to an embodiment of the present inventive concept, FIG. 2 is a perspective view illustrating a state in which developing units are mounted in a main body of the image forming apparatus, FIG. 3 is a perspective view illustrating a state in which the developing units are separated from the main body of the image forming apparatus, and FIG. 4 is a perspective view illustrating a positional relationship between an image-carrier and the developing units.

As illustrated in FIGS. 1 to 4, the image forming apparatus 1 includes a main body 10, a printing media feeding unit 20, a light scanning unit 30, an image-carrier unit 100, a developing unit 40, a transfer unit 50, a fixing unit 60, and a printing media discharge unit 70.

The main body 10 defines an external appearance of the image forming apparatus 1 and supports a variety of elements received therein. A main body cover 11 is pivotally rotatably coupled to one side of the main body 10. The main body cover 11 is configured to open or close a partial region of the main body 10. As such, a user may access the interior of the main body 10 to attach or detach internal elements, such as an image-carrier unit 100 and the developing units 40.

The printing media feeding unit 20 includes a cassette 21 in which printing media S is stored, a pickup roller 22 to pick up the printing media S stored in the cassette 21 one by one, and a delivery roller 23 to deliver each picked printing medium toward the transfer unit 50.

The light scanning unit 30 is placed below the image-carrier unit 100 and serves to form an electrostatic latent image on a surface of an image-carrier 120 by irradiating light corresponding to image information to the image-carrier 120.

The image-carrier unit 100 includes an image-carrier housing 110, the image-carrier 120 rotatably installed to the image-carrier housing 110 to carry the electrostatic latent image formed by the light scanning unit 30 as well as a visible image formed by the developing unit 40, a first driven-coupling 130 connected to a rotating shaft of the image-carrier 120, and a charging roller 140 to charge the image-carrier 120 with a predetermined electric potential before the light scanning unit 30 irradiates light to the image-carrier 120.

The developing unit 40 serves to form a visible image on the image-carrier 120 by feeding developer to the image-carrier 120 on which the electrostatic latent image has been formed. The developing unit 40 may include four developing devices 40Y, 40M, 40C and 40K, in which different colors of developers, for example, yellow (Y), magenta (M), cyan (C), and black (K) color developers are received respectively.

Each of the developing devices 40Y, 40M, 40C and 40K includes a developer receptacle 41, a feed roller 42, a developing roller 43, and second driven-couplings 48 connected to a rotating shaft of the developing roller 43. Each developer receptacle 41 stores developer to be fed to the image-carrier 120, and each feed roller 42 feeds the developer stored in the respective developer receptacle 41 to the respective developing roller 43. Each developing roller 43 attaches the developer to the surface of the image-carrier 120 on which the electrostatic latent image has been formed, so as to form a visible image.

The respective developing devices 40Y, 40M, 40C and 40K are separably mounted to the main body 10 via guide rails 15.

The transfer unit 50 includes an intermediate transfer belt 51, a first transfer roller 52, and a second transfer roller 53.

The intermediate transfer belt 51 is supported by support rollers 54 and 55, and is moved at the same velocity as a linear velocity of the image-carrier 120. The first transfer roller 52 opposites the image-carrier 120 with the intermediate transfer belt 51 interposed therebetween, and transfers the visible image formed on the image-carrier 120 to the intermediate transfer belt 51.

The second transfer roller 53 opposites the support roller 55 with the intermediate transfer belt 51 interposed therebetween. The second transfer roller 53 is spaced apart from the intermediate transfer belt 51 while the image is transferred from the image-carrier 120 to the intermediate transfer belt 51. After the image of the image-carrier 120 is completely transferred to the intermediate transfer belt 51, the second transfer roller 53 is brought into contact with the intermediate transfer belt 51 at a predetermined pressure. Once the second transfer roller 53 has come into contact with the intermediate transfer belt 51, the image of the intermediate transfer belt 51 is transferred to the printing medium.

The fixing unit 60 includes a heating roller 61 containing a heat source, and a pressure roller 62 installed to face the heating roller 61. When the printing medium passes between the heating roller 61 and the pressure roller 62, the image is fixed to the printing medium by heat transmitted from the heating roller 61 and pressure applied between the heating roller 61 and the pressure roller 62.

The printing media discharge unit 70 may include a discharge roller 71 and a backup roller 72 to discharge the printing medium having passed through the fixing unit 60 to the outside of the main body 10.

Now, operation of the image forming apparatus having the above-described configuration will be described in brief. Once a printing operation has begun, the surface of the image-carrier 120 is evenly charged by the charging roller 140. The light scanning unit 30 irradiates light corresponding to information on any one color image, for example, a yellow image to the evenly charged surface of the image-carrier 120. As such, an electrostatic latent image corresponding to the yellow image is formed on the image-carrier 120.

Subsequently, as a developing bias is applied to the developing roller 43 of the yellow developing device 40Y, yellow developer is attached to the electrostatic latent image, causing a yellow visible image to be formed on the image-carrier 120. The visible image is transferred to the intermediate transfer belt 51 via the first transfer roller 52.

After transfer of the single-page yellow image is completed, the light scanning unit 30 irradiates light corresponding to information on another color image, for example, a magenta image to the image-carrier 120, forming an electrostatic latent image corresponding to the magenta image. The magenta developing device 40M feeds magenta developer to the electrostatic latent image to form a visible image. The magenta visible image formed on the image-carrier 120 is transferred to the intermediate transfer belt 51 via the first transfer roller 52. In this case, the magenta visible image overlaps with the visible yellow image that has previously been transferred.

When performing the above-described procedure with respect to cyan and black images, a color image in which the yellow, magenta, cyan and black images overlap with one another is formed on the intermediate transfer belt 51. The resulting color image is transferred to the printing medium passing between the intermediate transfer belt 51 and the second transfer roller 53, and the printing medium is discharged outward of the main body 10 via the printing media discharge unit 70.

An assembly to drive the image-carrier 120 and the developing unit 40 is provided in a side region of the main body 10.

Figure 5:
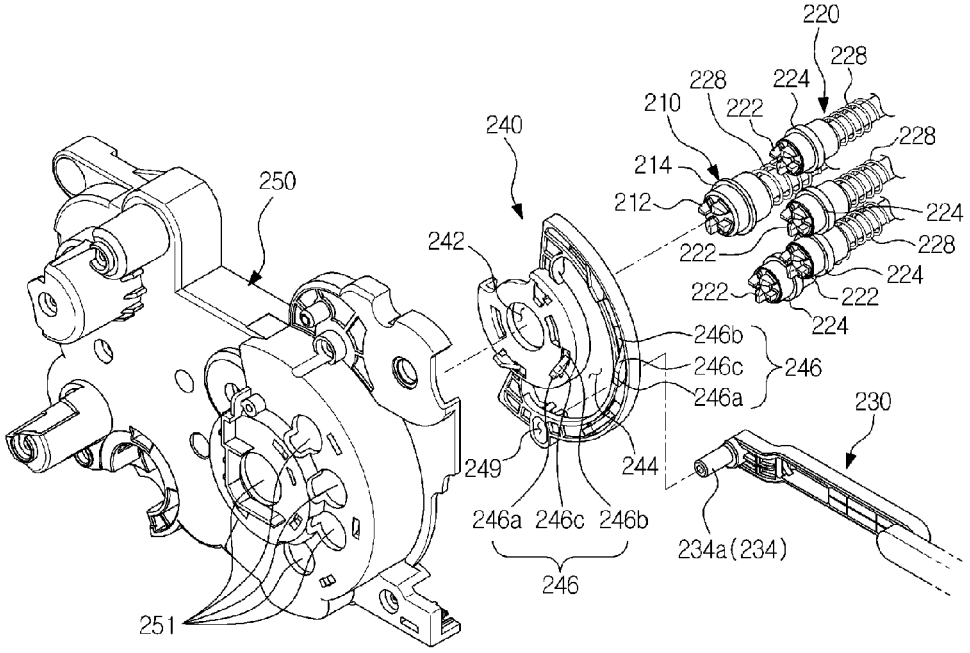
FIG. 5 is an exploded perspective view illustrating an assembly to drive the image-carrier and the developing units.
Figure 6:
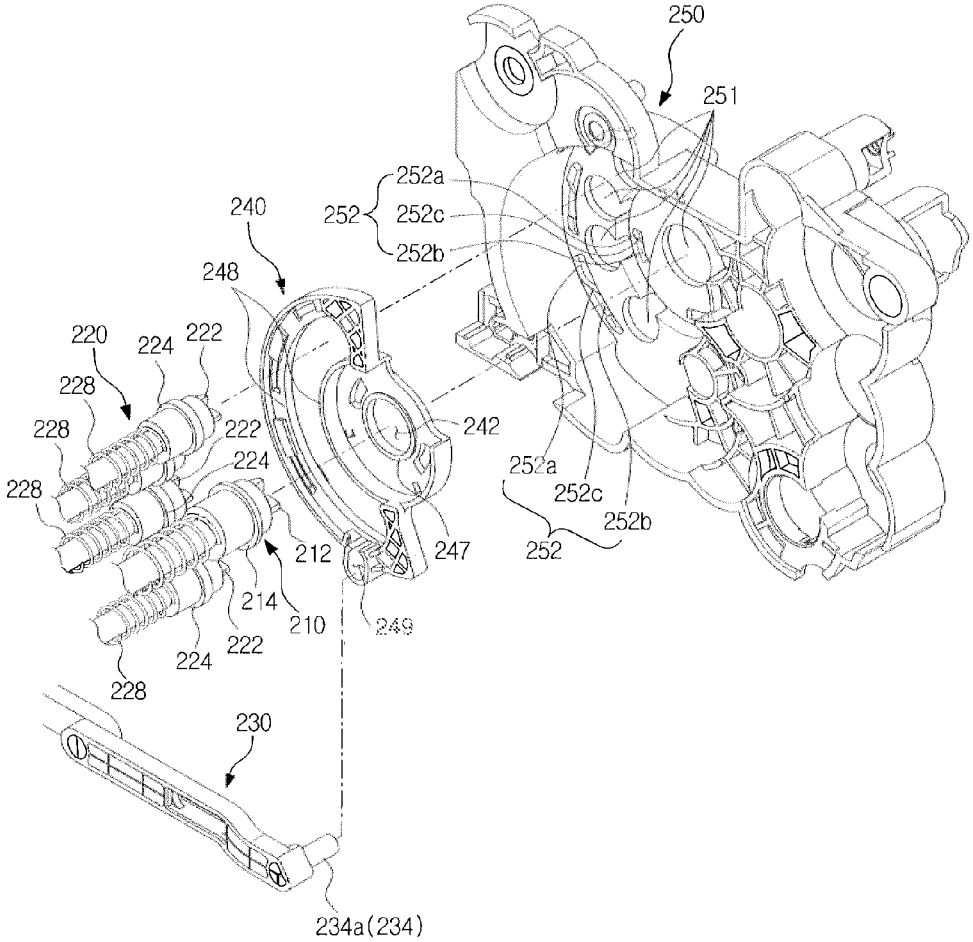
FIG. 6 is an exploded perspective view of the assembly of FIG. 5 viewed at a different angle.

FIG. 5 is an exploded perspective view illustrating an assembly to drive the image-carrier and the developing units, and FIG. 6 is an exploded perspective view when viewed at a different angle from FIG. 5.

As illustrated in FIGS. 5 and 6, the assembly to drive the image-carrier 120 and the developing unit 40 includes a first driving-coupling 210 and second driving-couplings 220 which engage with the first driven-coupling 130 and the second driven-couplings 48, respectively, to transmit a drive power generated by a drive source, such as a drive motor (not shown), to the image-carrier 120 and developing rollers 43, a link unit 230 which is moved according to opening/closing operations of the cover 11, a guide unit 240 which is operated in linkage with the link unit 230 to couple or separate the first driving-coupling 210 and second driving-couplings 220 to or from the first driven-coupling 130 and second driven-couplings 48, and a guide cover 250 which is configured to receive the first driving-coupling 210, second driving-couplings 220 and guide unit 240.

The first driving-coupling 210 includes a plurality of bosses 212 to engage with the first driven-coupling 130, and a first flange 214 which comes into contact with one surface of the guide unit 240. Each second driving-coupling 220 includes a plurality of bosses 222 to engage with the second driven-coupling 48, and a second flange 224 which comes into contact with one surface of the guide unit 240.

Elastic members 228 are provided to press the first flange 214 and second flange 224 toward the first driven-coupling 130 and second driven-coupling 48, respectively, which ensures that the first and second flanges 214 and 224 continuously come into contact with one surface of the guide unit 240.

The first driving-coupling 210 is positioned to correspond to the first driven-coupling 130, and the second driving-couplings 220 are positioned to correspond to the respective second driven-couplings 48. As such, the second driving-couplings 220 are concentrically arranged about the first driving-coupling 210.

The guide unit 240 takes the form of a partially incised disc and is rotatable about the first driving-coupling 210. The guide unit 240 includes a first through-hole 242 formed in the rotation center thereof, a second through-hole 244 formed in a circumferential direction of a concentric circle defined by the second driving-couplings 220, a first support portion 247 to support the first driving-coupling 210, a second support portion 248 to support the second driving-couplings 220, and a second guide portion 246 to guide axial movement of the guide unit 240 during rotation of the guide unit 240.

The first driving-coupling 210 is connected to the first driven-coupling 130 via the through-hole 242, and the second driving-couplings 220 are connected to the second driven-couplings 48 via the second through-hole 244.

The first support portion 247 is formed along the first through-hole 242 to support the first flange 214 of the first driving-coupling 210. The second support portion 248 is formed along the second through-hole 244 to support the second flanges 224 of the second driving-couplings 220. The first flange 214 has a greater diameter than a diameter of the first through-hole 242, and the second flange 224 has a greater diameter than a radial width of the second through-hole 244.

At least one second guide portion 246 is placed in the circumferential direction or rotating direction of the guide unit 240. The second guide portion 246 includes a second guide protrusion 246*a*, which comes into contact with a first guide protrusion 252*a* of a first guide portion 252 or is received in a first receiving recess 252*b* provided at the guide cover 250 that will be described hereinafter, and a second receiving recess 246*b* in which the first guide protrusion 252*a* is received.

The second guide protrusion 246*a* has a second slope 246*c* coming into contact with a first slope 252*c* of the first guide protrusion 252*a* to enable relative movement thereof. As the guide unit 240 is rotated, the second guide protrusion 246*a* may come into contact with the first guide protrusion 252*a* or may be received in the first receiving recess 252*b* to enable axial movement of the guide unit 240.

The guide cover 250 includes through-holes 251 to enable connection between the first and second driving-couplings 210 and 220 and the first and second driven-couplings 130 and 48, and the first guide portion 252 to guide axial movement of the guide unit 240 according to rotation of the guide unit 240.

The first guide portion 252 is provided to correspond to the second guide protrusion 246*a*. The first guide portion 252 includes the first guide protrusion 252*a* which protrudes from an inner surface of the guide cover 250 facing the guide unit 240 and has a first slope 252*c* that is inclined in the rotating direction of the guide unit 240, and a first receiving recess 252*b* in which the second guide protrusion 246*a* is received.

As the guide unit 240 is rotated, the first guide protrusion 252*a* may come into contact with the second guide protrusion 246*a* or may be received in the second receiving recess 246*b* to enable axial movement of the guide unit 240.

The link unit 230 includes a first connecting portion 232 connected to the cover 11 and a second connecting portion 234 connected to the guide unit 240. The first connecting portion 232 has a guide groove 232*a* to guide pivotal rotation of the cover 11 as the cover 11 opens or closes the main body 10. The second connecting portion 234 has a fastening boss 234*a* fitted into a fastening hole 249 of the guide unit 240 to guide pivotal rotation of the guide unit 240.

The link unit 230 is moved in a direction A or in a direction opposite to the direction A (see FIG. 8) in linkage with pivotal rotation of the cover 11 to open or close a portion of the main body 10. The guide unit 240 rotates in a direction B and in a direction opposite to the direction B (see FIG. 8) in linkage with the link unit 230.

Hereinafter, the procedure and principle in which the first and second driving-couplings 210 and 220 are coupled to or separated from the first and second driven-couplings 130 and 48 according to opening/closing operations of the cover 11 will be described.

Figure 7:
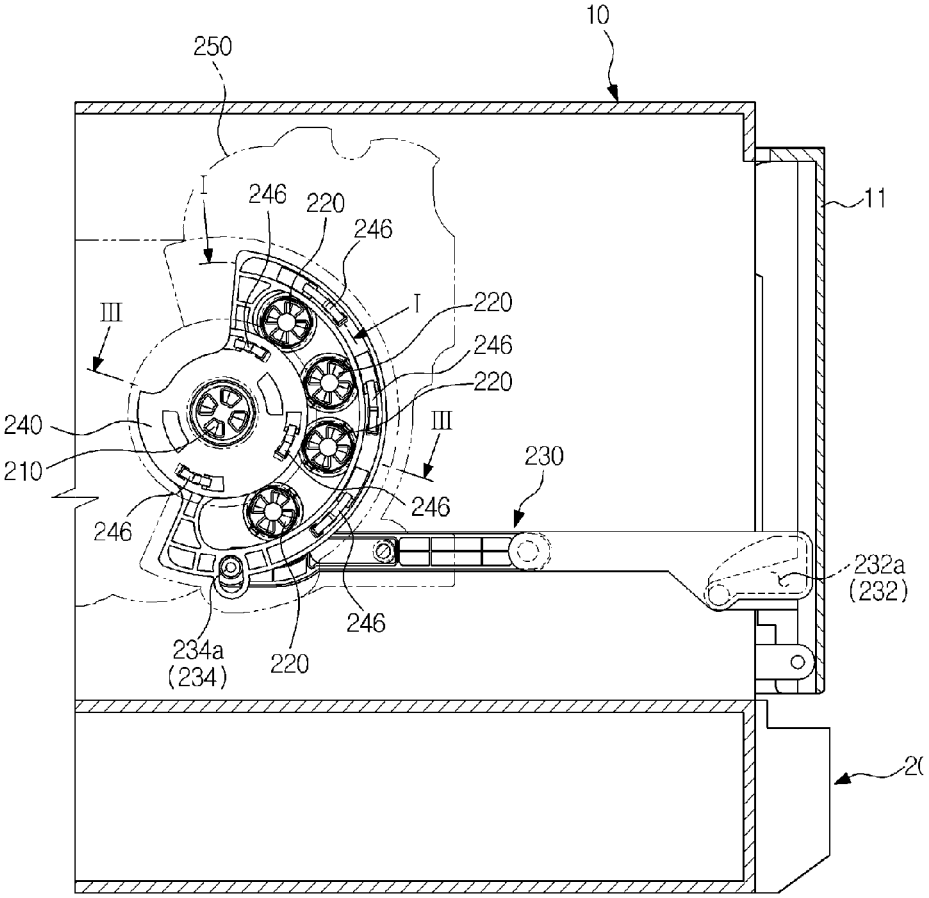
FIG. 7 is a view illustrating a positional relationship between a link unit and a guide unit in a state in which a cover closes the main body of the image forming apparatus.
Figure 8:
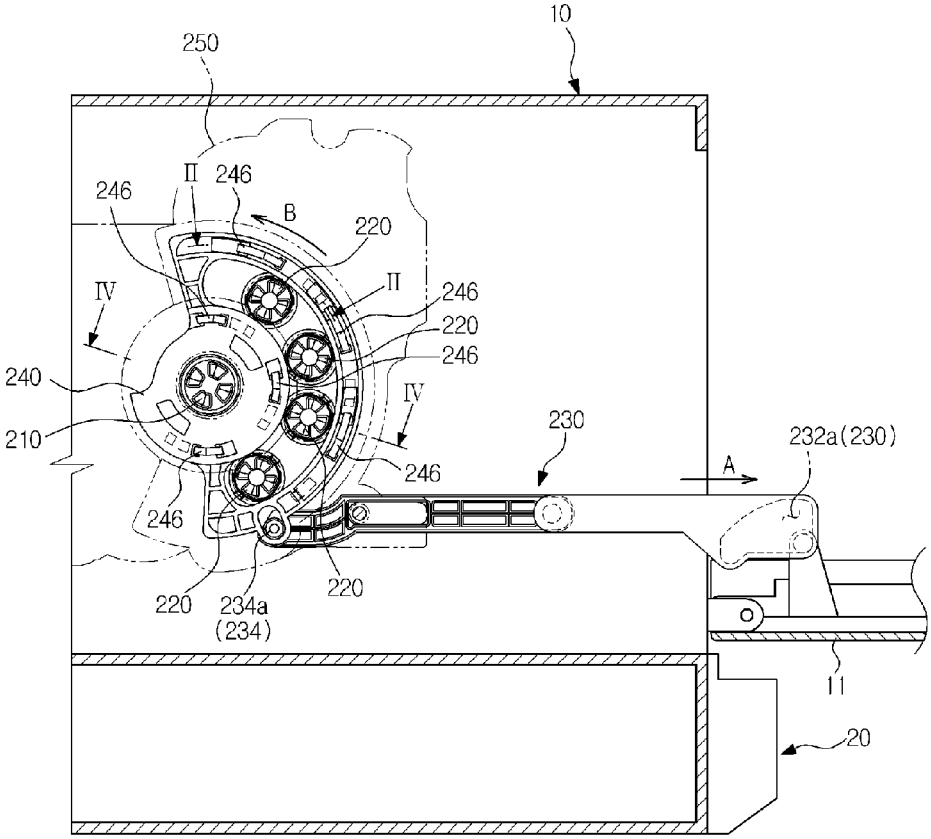
FIG. 8 is a view illustrating a positional relationship between the link unit and the guide unit in a state in which the cover opens the main body of the image forming apparatus.
Figure 9:
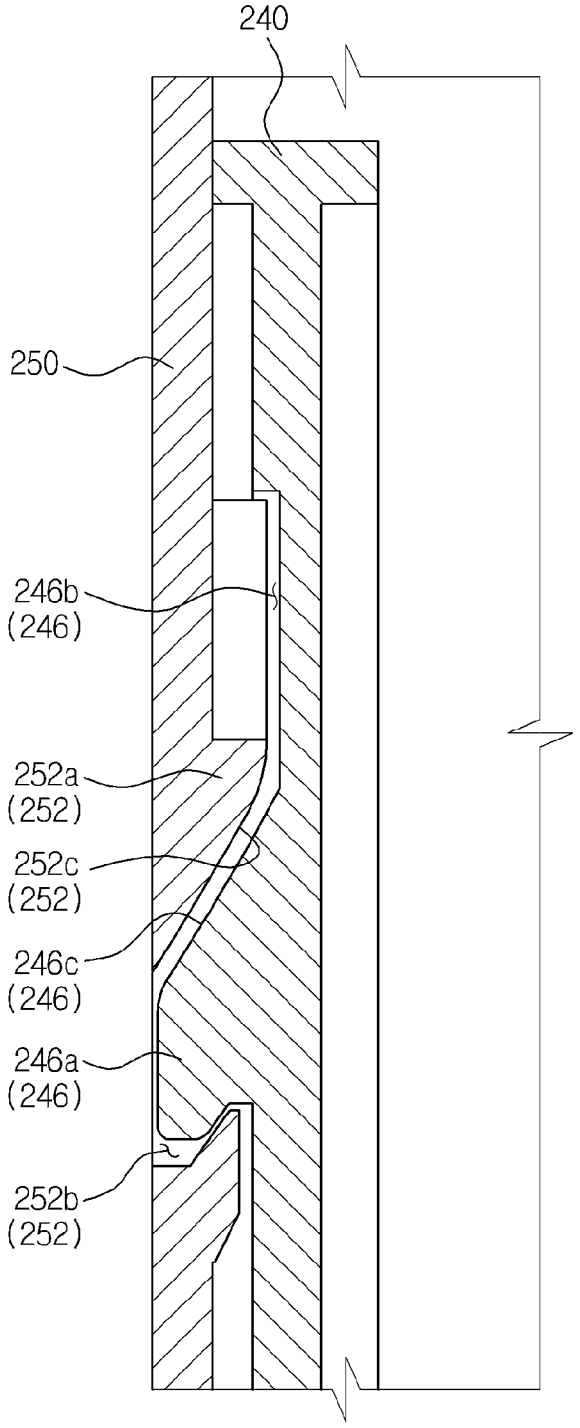
FIG. 9 is a sectional view taken along line I-I of FIG. 7 illustrating a positional relationship between a first guide protrusion and a second guide protrusion in a state in which the cover closes the main body of the image forming apparatus.
Figure 10:
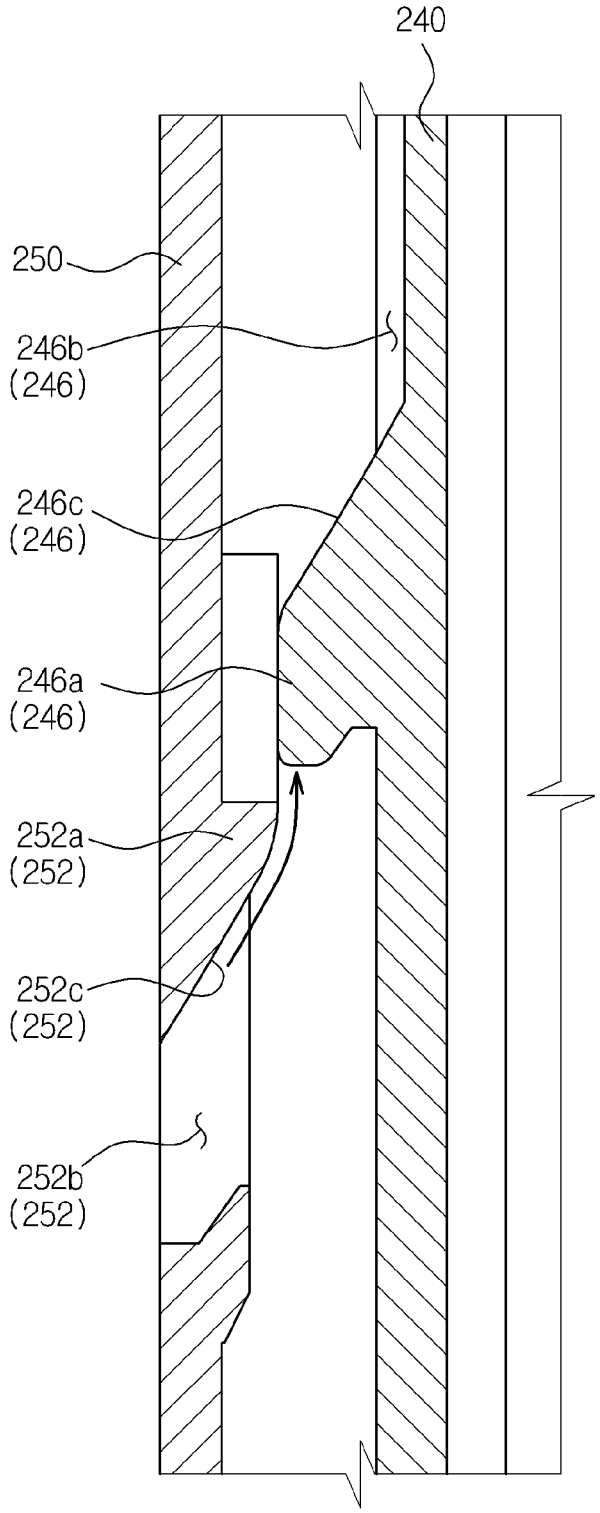
FIG. 10 is a sectional view taken along line II-II of FIG. 8 illustrating a positional relationship between the first guide protrusion and the second guide protrusion in a state in which the cover opens the main body of the image forming apparatus.
Figure 11:
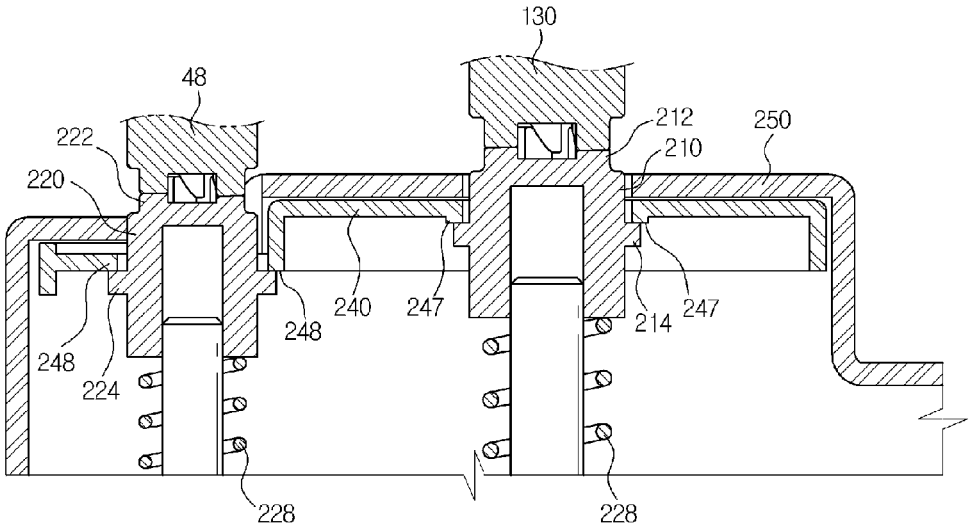
FIG. 11 is a sectional view taken along line III-III of FIG. 7 illustrating a connection relationship between a driving-coupling and a driven-coupling in a state in which the cover closes the main body of the image forming apparatus.
Figure 12:
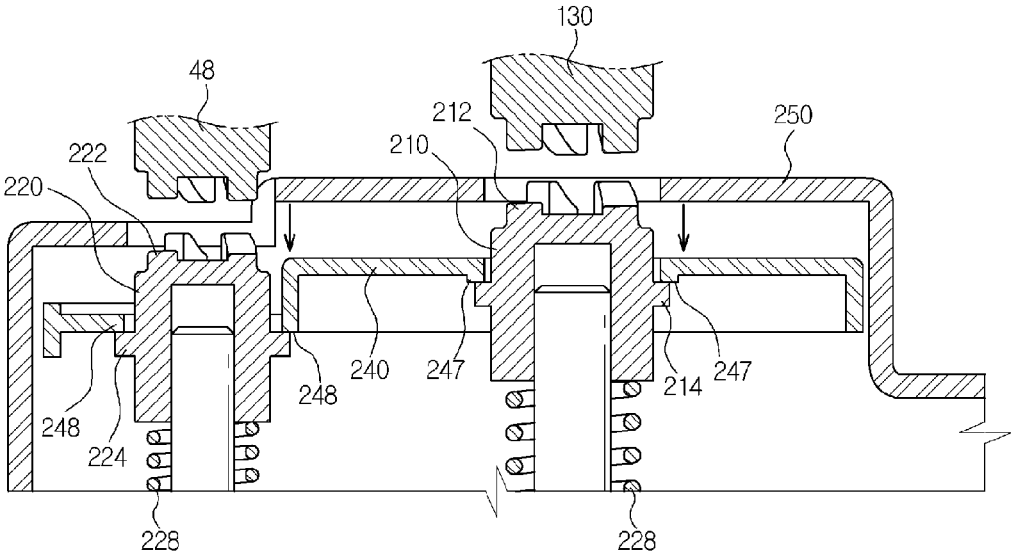
FIG. 12 is a sectional view taken along line IV-IV of FIG. 8 illustrating a positional relationship between the driving-coupling and the driven-coupling in a state in which the cover opens the main body of the image forming apparatus.

FIG. 7 is a view illustrating a positional relationship between the link unit 230 and the guide unit 240 in a state in which the cover 11 closes the main body, FIG. 8 is a view illustrating a positional relationship between the link unit 230 and the guide unit 240 in a state in which the cover 11 opens the main body, FIG. 9 is a sectional view taken along line I-I of FIG. 7 illustrating a positional relationship between the first guide protrusion 252*a* and the second guide protrusion 246*a* in a state in which the cover 11 closes the main body, FIG. 10 is a sectional view taken along line II-II of FIG. 8 illustrating a positional relationship between the first guide protrusion 252*a* and the second guide protrusion 246*a* in a state in which the cover 11 opens the main body, FIG. 11 is a sectional view taken along line III-III of FIG. 7 illustrating a connection relationship between the driving-couplings and the driven-couplings in a state in which the cover closes the main body, and FIG. 12 is a sectional view taken along line IV-IV of FIG. 8 illustrating a positional relationship between the driving-couplings and the driven-couplings in a state in which the cover opens the main body.

As illustrated in FIG. 8, if the cover 11 is pivotally rotated to open the main body 10, the link unit 230, connected to the cover 11, is moved in the direction A in linkage with the cover 11, and the guide unit 240, connected to the link unit 230, is pivotally rotated in the direction B about the first driving-coupling 210.

If the guide unit 240 is pivotally rotated in the direction B, as illustrated in FIG. 10, the second guide protrusion 246*a*, which was previously received in the first receiving recess 252*b*, is then moved along the first slope 252*c* of the first guide protrusion 252*a* formed at the guide cover 250, thereby being engaged with the first guide protrusion 252*a*.

As the second guide protrusion 246*a* engages with the first guide protrusion 252*a*, the first and second support portions 247 and 248 of the guide unit 240 and the elastic members 228 cause the guide unit 240 to press the first and second driving-couplings 210 and 220 coming into contact with one surface of the guide unit 240. Thereby, the first and second driving-couplings 210 and 220 as well as the guide unit 240 are moved away from the first and second driven-couplings 130 and 48, thereby being separated from the first and second driven-couplings 130 and 48.

After the first and second driving-couplings 210 and 220 are separated from the first and second driven-couplings 130 and 48, replacement of the developing unit 40 may be possible through one side of the main body 10 that is opened by the cover 11.

As illustrated in FIG. 7, if the cover 11 is pivotally rotated to close the main body 10 in a state in which the developing unit 40 is mounted in the main body 10, the link unit 230 connected to the cover 11 is moved in the direction opposite to the direction A in linkage with the cover 11, and the guide unit 240 connected to the link unit 230 is pivotally rotated in the direction opposite to the direction B about the first driving-coupling 210.

Once the guide unit 240 has been pivotally rotated in the direction opposite to the direction B, as illustrated in FIG. 9, the second guide protrusion 246*a*, previously engaged with the first guide protrusion 252*a*, is moved along the first slope 252*c* of the first guide protrusion 252*a* formed at the guide cover 250, thereby being received in the first receiving recess 252*b*.

As the second guide protrusion 246*a* is received in the first receiving recess 252*b*, the first and second support portions 247 and 248 of the guide unit 240 and the elastic members 228 cause the guide unit 240 and the first and second driving-couplings 210 and 220 to come into contact with one surface of the guide unit 240 to be moved toward the first and second driven-couplings 130 and 48, thereby engaging with the first and second driven-couplings 130 and 48.

After the first and second driving-couplings 210 and 220 are engaged with the first and second driven-couplings 130 and 48, respectively, a printing operation may be performed as the first and second driving-couplings 210 and 220 are driven to rotate the image-carrier 120 and the developing roller 43.

As described above, through the link unit 230 being moved in linkage with the cover 11, the guide unit 240 being moved in linkage with the link unit 230 and the guide cover 250 to guide axial movement of the guide unit 240, the first driving-coupling 210 to drive the image-carrier 120 and the second driving-couplings 220 to drive the respective developing rollers 43 may be engaged with or separated from the first driven-coupling 130 and the second driven-couplings 48. In this way, a simplified assembly to drive the image-carrier 140 and the developing rollers 43 is accomplished.

As is apparent from the above description, according to the embodiments of the present inventive concept, an assembly to couple or separate driving-couplings to or from an image-carrier and a developing unit is simplified, resulting in reduced material costs and enhanced productivity.

Further, the simplified assembly to couple or separate the driving-couplings to or from the image-carrier and developing unit occupies a smaller space, which enables reduction in the size of an image forming apparatus.

Although a few embodiments of the present inventive concept have been shown and described, it would be appreciated by those skilled in the art that changes may be made in these embodiments without departing from the principles and spirit of the inventive concept, the scope of which is defined in the claims and their equivalents.

What is claimed is:

1. An image forming apparatus comprising:

a main body;

a cover to open or close one side of the main body;

an image-carrier unit placed in the main body and including an image-carrier on which an image is formed and a first driven-coupling connected to a rotating shaft of the image-carrier;

a plurality of developing units mounted in the main body to slidably move through the one side of the main body opened by the cover, each of which includes a developing roller to feed developer to the image-carrier and a second driven-coupling connected to a rotating shaft of the developing roller;

a first driving-coupling and second driving-couplings located at a side region of the main body to transmit a drive power generated from a drive source to the first driven-coupling and the second driven-couplings;

a link unit to move in a first direction in linkage with opening/closing operations of the cover; and a guide unit to be rotatable about a rotating shaft of the first driving-coupling in linkage with the link unit, the guide unit being adapted to move in a second direction perpendicular to the first direction when rotated about the rotating shaft of the first driving-coupling so as to couple or separate the first driving-coupling to or from the first driven-coupling and to couple or separate the second driving couplings to or from the second driven-couplings.

2. The image forming apparatus according to claim 1, wherein the second driven-couplings are concentrically arranged about the first driven-coupling in a state in which the plurality of developing units is mounted in the main body.

3. The image forming apparatus according to claim 1, wherein the second driving-couplings are concentrically arranged about the first driving-coupling.

4. The image forming apparatus according to claim 1, wherein the first driving-coupling and the second driving-couplings are pressed by the guide unit and are connected respectively to the first driven-coupling and the respective second driven-coupling as the cover closes the one side of the main body, and are no longer pressed by the guide unit and are separated from the first driven-coupling and the second driven-coupling as the cover opens the one side of the main body.

5. The image forming apparatus according to claim 2, wherein the guide unit includes a first through-hole formed in a rotation center thereof, and a second through-hole formed in a circumferential direction of a concentric circle defined by the second driving-couplings.

6. The image forming apparatus according to claim 5, wherein:

the first driving-coupling is connected to the first driven-coupling via the first through-hole; and the second driving-couplings are connected to the respective second driven-couplings via the second through-hole.

7. The image forming apparatus according to claim 6, wherein the guide unit includes a first support portion and a second support portion formed at one surface thereof, the first support portion being formed along the first through-hole to support the first driving-coupling, and the second support portion being formed along the second through-hole to support the second driving-couplings.

8. The image forming apparatus according to claim 7, wherein the first driving-coupling includes a first flange having a greater diameter than a diameter of the first through-hole so as to be supported by the first support portion.

9. The image forming apparatus according to claim 8, wherein the second driving-couplings include a second flange having a greater diameter than a radial width of the second through-hole so as to be supported by the second support portion.

10. The image forming apparatus according to claim 9, further comprising:

a plurality of elastic members to press the first driving-coupling and the second driving-couplings toward the first driven-coupling and the second driven-couplings, so as to maintain contact between the first and second flanges and the first and second support portions.

11. The image forming apparatus according to claim 1, wherein the second direction is an axial direction of the rotating shaft of the first driving-coupling.

12. The image forming apparatus according to claim 10, further comprising:

a guide cover provided at the one side of the main body to receive the guide unit, wherein the guide cover includes at least one first guide protrusion to come into contact with one surface of the guide unit so as to guide movement of the guide unit in the second direction as the guide unit rotates about the rotating shaft of the first driving-coupling.

13. The image forming apparatus according to claim 12, wherein the guide unit includes at least one second guide protrusion to come into contact with the first guide protrusion so as to guide movement of the guide unit in the second direction.

14. The image forming apparatus according to claim 13, wherein the first guide protrusion includes a slope to guide movement of the second guide protrusion as the guide unit rotates about the rotating shaft of the first driving-coupling.

15. The image forming apparatus according to claim 14, wherein the slope is inclined in a rotating direction of the guide unit.

16. The image forming apparatus according to claim 12, wherein the at least one first guide protrusion and the at least one second guide protrusion are arranged in the rotating direction of the guide unit.

17. An image forming apparatus comprising:

a main body;

a cover to open and close one side of the main body;

an image carrier and a plurality of developing rollers placed in the main body;

a plurality of driven-couplings including a first driven-coupling connected to a rotating shaft of the image carrier and second driven-couplings connected to rotating shafts of the developing rollers;

a plurality of driving-couplings including a first driving-coupling and second-driving couplings placed in a side region of the main body to transmit drive power generated from a drive source to the first driven-coupling and the second driven-couplings, respectively;

a link unit to move in linkage with opening/closing operations of the cover; and a guide unit to be rotatable about a rotating shaft of the first driving-coupling in linkage with the link unit, the guide unit being adapted to move toward the driven-couplings when rotated so as to cause the driving-couplings to be engaged with the driven-couplings, and to move away from the driven-couplings when rotated so as to cause the driving-couplings to be separated from the driven-couplings.

18. The image forming apparatus according to claim 17, wherein the guide unit includes a plurality of through-holes perforated therein to enable connection between the plurality of driving-couplings and the plurality of driven-couplings, and a plurality of support portions formed on peripheries of the through-holes to support the plurality of driving-couplings.

19. The image forming apparatus according to claim 18, further comprising a plurality of elastic members to press the driving-couplings toward the driven-couplings, so as to allow the driving-couplings to be supported by the support portions and be moved in a rotating shaft direction of the driving-couplings along with the guide unit.

20. The image forming apparatus according to claim 19, wherein:

the plurality of driven-couplings include the plurality of second driven-couplings is-concentrically arranged about the first driven-coupling.

21. The image forming apparatus according to claim 20, wherein the plurality of driving-couplings include the first driving-coupling positioned to correspond to the first driven-coupling so as to be engaged with the first driven-coupling, and a the second driving-couplings positioned to correspond to the second driven-couplings so as to be engaged with the second driven-couplings.

22. The image forming apparatus according to claim 21, wherein the guide unit is movable in the rotating shaft direction of the first driving-coupling when rotated about the rotating shaft of the first driving-coupling.

23. The image forming apparatus according to claim 22, further comprising a guide cover provided at the one side of the main body to receive the guide unit.

24. The image forming apparatus according to claim 23, wherein:

the guide cover includes a first guide portion formed at an inner surface thereof facing one surface of the guide unit; and the first guide portion includes a first guide protrusion having a first slope that is inclined in a rotating direction of the guide unit.

25. The image forming apparatus according to claim 24, wherein:

at least one second guide portion is placed at one surface of the guide unit in the rotating direction of the guide unit to guide movement of the guide unit along with the first guide portion; and the second guide portion includes a second guide protrusion having a second slope that moves relative to the first slope in contact with the first slope as the guide unit is rotated.

26. The image forming apparatus according to claim 25, wherein:

the first guide portion includes a first receiving recess in which the second guide protrusion is received in a state in which the cover closes the main body; and the second guide portion includes a second receiving recess in which the first guide protrusion is received in a state in which the cover closes the main body.

27. The image forming apparatus according to claim 26, wherein one end of the first guide protrusion and one end of the second guide protrusion come into contact with each other in a state in which the cover opens the main body.

28. The image forming apparatus according to claim 17, wherein the guide unit moves toward the driven-couplings as the cover closes the main body, so as to allow the driving-couplings to be engaged with the driven-couplings, and moves away from the driven-couplings as the cover opens the main body, so as to allow the driving-couplings to be separated from the driven-couplings.

29. An image forming apparatus comprising:

a main body;

a cover to open and close one side of the main body;

a first driven-coupling and second driven-couplings to drive an image carrier and developing rollers, respectively;

a first driving-coupling and second driving-couplings to transmit a drive power generated from a drive source to the first driven-coupling and second driven-couplings, respectively; and a guide unit to be rotatable about a rotating shaft of the first driving-coupling and configured to move toward the driven-couplings when rotated in a first direction so as to cause the driving-couplings to be engaged with the driven-couplings, and to move away from the driven-couplings when rotated in a second direction so as to cause the driving-couplings to be separated from the driven-couplings.

30. The image forming apparatus according to claim 29, further comprising:

a link unit to move in linkage with opening/closing operations of an access cover of the main body such that the guide unit rotates with the movement of the link unit.

31. The image forming apparatus according to claim 30, wherein the guide unit moves about the rotating shaft of the first driving-coupling and in a direction perpendicular to the movement of the link unit to perform the coupling and decoupling of the driving-couplings and the driven-couplings.

32. The image forming apparatus according to claim 30, wherein:

the second driven-couplings are disposed concentric with respect to the first driven-coupling; and the second driving-couplings are disposed concentric with respect to the second driven-couplings.

33. The image forming apparatus according to claim 30, wherein the first driving-coupling and second driving-couplings each include an elastic member to simultaneously bias the first driving-coupling and second driving-couplings toward the respective first driven-coupling and second driven-couplings as the guide unit rotates.

34. The image forming apparatus according to claim 33, wherein the first driving-coupling and second driving-couplings simultaneously move toward the first driven-coupling and second driven-couplings when the access cover is being closed, and move away from the first driven-coupling and second driven-couplings when the access cover is being opened.

35. The image forming apparatus according to claim 32, wherein the guide unit includes a first through-hole formed in the rotation center thereof, a second through-hole formed in a circumferential direction of a concentric circle defined by the second driving-couplings, a first support portion to support the first driving-coupling, a second support portion to support the second driving-couplings, and a guide portion to guide axial movement of the guide unit during rotation of the guide unit.

36. The image forming apparatus according to claim 35, wherein the first driving-coupling is connected to the first driven-coupling via the first through-hole, and the second driving-couplings are connected to the second driven-couplings via the second through-hole.

* * * * *

UNITED STATES PATENT AND TRADEMARK OFFICE

CERTIFICATE OF CORRECTION

PATENT NO. : 8,977,165 B2
APPLICATION NO. : 13/680398
DATED : March 10, 2015
INVENTOR(S) : Tae Il Jung et al.

It is certified that error appears in the above-identified patent and that said Letters Patent is hereby corrected as shown below:

In the Claims

Claim 21, column 13, line 38, delete "a the" and insert --the--, therefor.

Signed and Sealed this
Twenty-third Day of June, 2015

Michelle K. Lee

Michelle K. Lee
*Director of the United States Patent and Trademark Office*